US007836719B2

(12) United States Patent
Jeong et al.

(10) Patent No.: US 7,836,719 B2
(45) Date of Patent: Nov. 23, 2010

(54) ICE SUPPLY DEVICE

(75) Inventors: Kyung Han Jeong, Seoul (KR); Wook Yong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 200 days.

(21) Appl. No.: 11/951,415

(22) Filed: Dec. 6, 2007

(65) Prior Publication Data

US 2008/0156016 A1 Jul. 3, 2008

(30) Foreign Application Priority Data

Dec. 31, 2006 (KR) ..... 10-2006-0139248

(51) Int. Cl.
*A23G 9/00* (2006.01)
*B02C 18/14* (2006.01)
*B67D 7/80* (2010.01)

(52) U.S. Cl. ..... 62/342; 241/190; 222/146.6

(58) Field of Classification Search ..... 62/342, 62/344; 222/146.1, 146.5, 146.6; 241/190
See application file for complete search history.

(56) References Cited

U.S. PATENT DOCUMENTS

| | | | | |
|---|---|---|---|---|
| 2,048,509 | A | 7/1936 | Melcher | |
| 2,803,410 | A | 8/1957 | Bodoni, Jr. | |
| 3,037,540 | A | 6/1962 | Bloomquist | |
| 4,972,999 | A | 11/1990 | Grace | |
| 5,056,688 | A | 10/1991 | Goetz et al. | |
| 6,082,130 | A | 7/2000 | Pastryk et al. | |
| 6,093,312 | A | 7/2000 | Boulter | |
| 6,148,624 | A | 11/2000 | Bishop et al. | |
| 6,314,745 | B1 | 11/2001 | Janke et al. | |
| 6,351,958 | B1 | 3/2002 | Pastryk et al. | |
| 6,607,096 | B2 | 8/2003 | Glass et al. | |
| 7,188,479 | B2 | 3/2007 | Anselmino et al. | |
| 7,201,005 | B2 | 4/2007 | Voglewede et al. | |
| 7,278,275 | B2 * | 10/2007 | Voglewede et al. | 62/320 |
| 2006/0196213 | A1 * | 9/2006 | Anderson | 62/344 |
| 2006/0248911 | A1 * | 11/2006 | An et al. | 62/344 |
| 2006/0248912 | A1 | 11/2006 | Park | |

FOREIGN PATENT DOCUMENTS

| | | | |
|---|---|---|---|
| EP | 1 710 520 | A2 | 10/2006 |
| KR | 10-2006-0004547 | A | 1/2006 |

OTHER PUBLICATIONS

Korean Office Action dated Oct. 23, 2007, for Korean Application No. 10-2006-0139248, (3 pages).
PCT International Search Report dated May 8, 2008, for Application No.: PCT/KR2007/005778, (5 pages).

* cited by examiner

*Primary Examiner*—Frantz F Jules
*Assistant Examiner*—Cassey Bauer
(74) *Attorney, Agent, or Firm*—Fish & Richardson P.C.

(57) ABSTRACT

An ice supply device is capable of supplying cubed ice, sliced ice, and grinded ice. The ice supply device is configured to supply cubed ice, sliced ice, or grinded ice based on a speed and direction of rotation of a rotary blade included in the ice supply device.

13 Claims, 5 Drawing Sheets

ICE SUPPLY DEVICE

This application claims the benefit of Korean Patent Application No. 10-2006-0139248, filed on Dec. 31, 2006, which is hereby incorporated by reference for all purposes as if set forth herein.

BACKGROUND

1. Field

The present disclosure relates to an ice supply device configured to supply multiple shapes of ice.

2. Discussion of Related Art

In general, a cooling device, such as a refrigerator, is widely used in homes, businesses, etc. An ice supply device can be provided in a refrigerating device to supply ice to users. An ice supply device may include a breaking device such that the ice supply device may supply ice in a crushed form.

SUMMARY

In one aspect, an appliance includes an ice maker configured to make ice, an ice storage bin configured to store ice made by the ice maker, a dispenser including an ice dispensing chute, and a housing configured to define an ice processing cavity. The housing includes an inlet configured to receive ice from the ice storage bin and an outlet configured to communicate with the ice dispensing chute to enable ejection of ice from within the housing to the ice dispensing chute. The appliance also includes an ice processing device provided in the ice processing cavity and including a rotary blade that has a relatively sharp side, a relatively dull side, and at least one protrusion extending from and positioned on a circumferential surface of an end of the rotary blade. The appliance further includes a controller configured to control a direction of rotation and a speed of rotation of the rotary blade to control a shape of ice processed by the ice processing device and communicated to the ice dispensing chute.

Implementations may include one or more of the following features. For example, the at least one protrusion may be part of a grinding member configured to process ice in a grinded shape. The ice processing device may include a fixed blade against which ice is sliced when the rotary blade is rotated such that the sharp side of the rotary blade engages ice. The rotary blade may include at least one additional protrusion extending from and positioned on a second circumferential surface of a second end of the rotary blade.

In some implementations, the circumferential surface of the end of the rotary blade may have a curved surface in the shape of an arc. In these implementations, a predetermined distance may be formed between the curved surface of the end of the rotary blade and the inner circumferential surface of the housing.

The rotary blade may include multiple protrusions extending from and positioned on the circumferential surface of the end of the rotary blade. A predetermined distance may be formed between an end of the protrusions and the inner circumferential surface of the housing. The at least one protrusion and the rotary blade may be integrally cast in a piece of metal.

In some examples, the appliance may include a separation preventing unit that extends convexly from the inlet of the housing. The separation prevention unit may be configured to guide an ice piece to contact the at least on protrusion when the ice processing device is configured to grind ice. In these examples, the separation preventing unit may be shaped to accommodate a typical piece of ice such that the separation prevention unit is configured to prevent separation of the ice piece from contacting the at least one protrusion when the ice processing device is configured to grind ice.

The controller may be configured to control the rotary blade to rotate in a first direction at a relatively low speed to process ice in a cubed shape. The controller may be configured to control the rotary blade to rotate in a second direction that is opposite the first direction at a relatively low speed to process ice in a sliced shape. The controller may be configured to control the rotary blade to rotate in the second direction at a relatively high speed to process ice in a grinded shape. The relatively high speed may be a speed sufficient to prevent a typical ice piece from completely entering the ice processing cavity without contacting the at least one protrusion.

In another aspect, an appliance includes an ice maker configured to make ice, an ice storage bin configured to store ice made by the ice maker, a dispenser including an ice dispensing chute, and an ice processing device configured to process ice in at least three shapes. The ice processing device includes an outlet configured allow ice processed by the ice processing device to enter the ice dispensing chute. The appliance also includes a user input device configured to receive a selection of a shape of ice the user desires to dispense. The desired shape of ice corresponds to one of the at least three shapes. The appliance further includes a controller configured to control the ice processing device to process ice in the desired shape of ice to allow dispensing of the desired shape of ice by the dispenser.

Implementations may include one or more of the following features. For example, the ice processing device may include a rotary blade and a fixed blade, and the controller may be configured to control a direction of rotation and a speed of rotation of the rotary blade to process ice in the desired shape of ice. The rotary blade may include a relatively sharp side, a relatively dull side, and at least one protrusion extending from and positioned on a circumferential surface of an end of the rotary blade.

In some implementations, the controller may be configured to control the rotary blade to rotate in a first direction at a relatively low speed to process ice in a cubed shape, the controller may be configured to control the rotary blade to rotate in a second direction that is opposite the first direction at a relatively low speed to process ice in a sliced shape, and the controller may be configured to control the rotary blade to rotate in the second direction at a relatively high speed to process ice in a grinded shape. In these implementations, the relatively high speed may be a speed sufficient to ensure a typical ice piece contacts an outer circumferential surface of the rotary blade.

The user input device may be configured to receive a selection of one of cubed ice, sliced ice, and grinded ice.

In yet another aspect, an appliance is controlled to dispense ice. User input indicating a selection of a shape of ice a user desires to dispense from among a list of at least three shapes is received. The at least three shapes include a first shape, a second shape that is generally smaller than the first shape, and a third shape that is generally smaller than the first shape and the second shape. A direction of rotation and a speed of rotation of a rotary blade included in an ice processing device of the appliance is controlled to process ice in the desired shape of ice selected by the user. Ice is dispensed from the appliance in a shape corresponding to the desired shape of ice selected by the user.

Implementations may include one or more of the following features. For example, the first shape may be a cubed shape, the second shape may be a sliced shape, and the third shape may be a grinded shape.

In some implementations, the rotary blade may be controlled to rotate in a first direction at a relatively low speed in response to receiving user input selecting the first shape of ice. The rotary blade may be controlled to rotate in a second direction opposite the first direction at a relatively low speed in response to receiving user input selecting the second shape of ice. The rotary blade may be controlled to rotate in the second direction at a relatively high speed in response to receiving user input selecting the third shape of ice.

DETAILED DESCRIPTION

Figure 1:
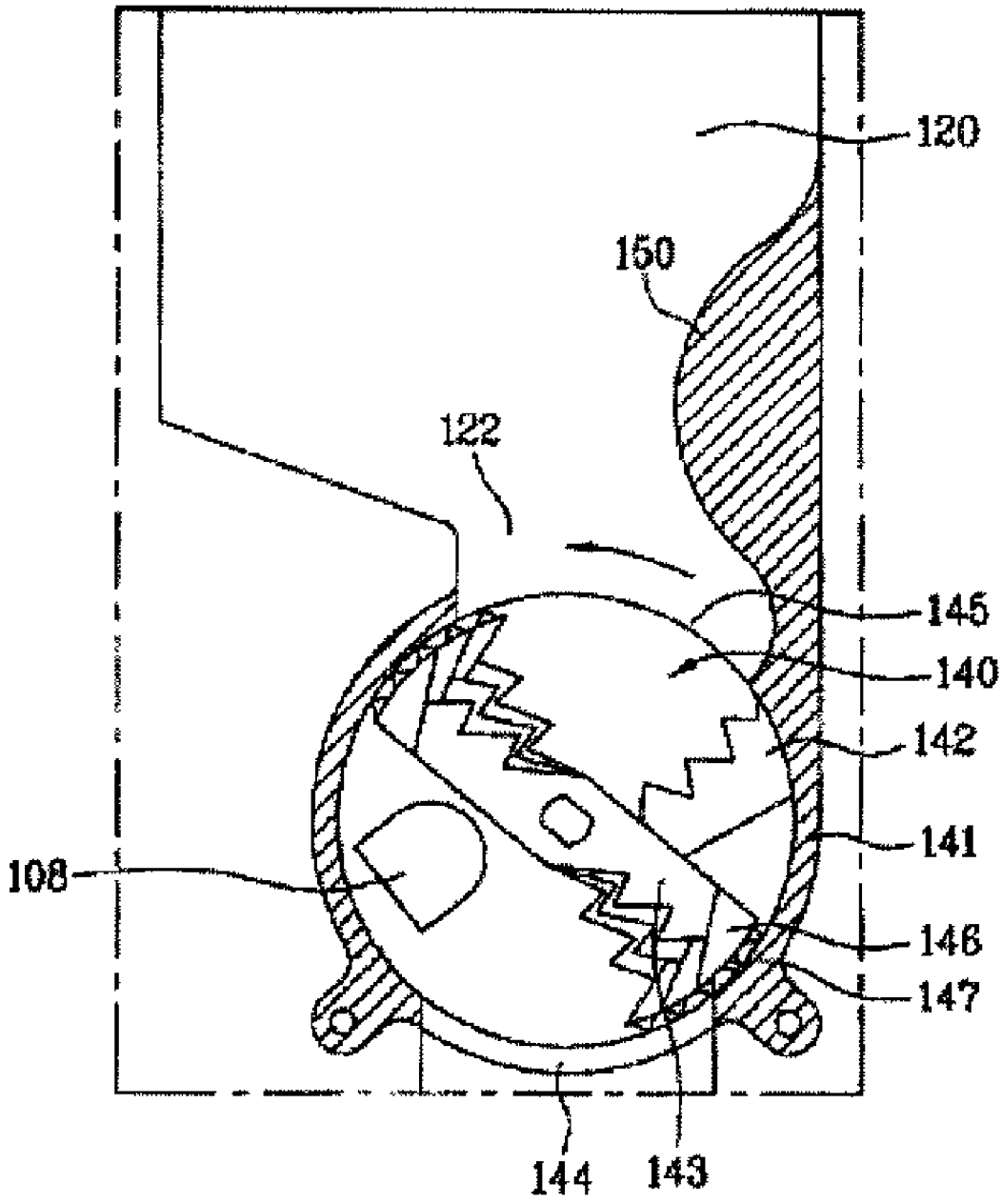
FIG. 1 is a cross sectional view illustrating an example of ice supply device in a mode configured to supply cubed ice.
Figure 2:
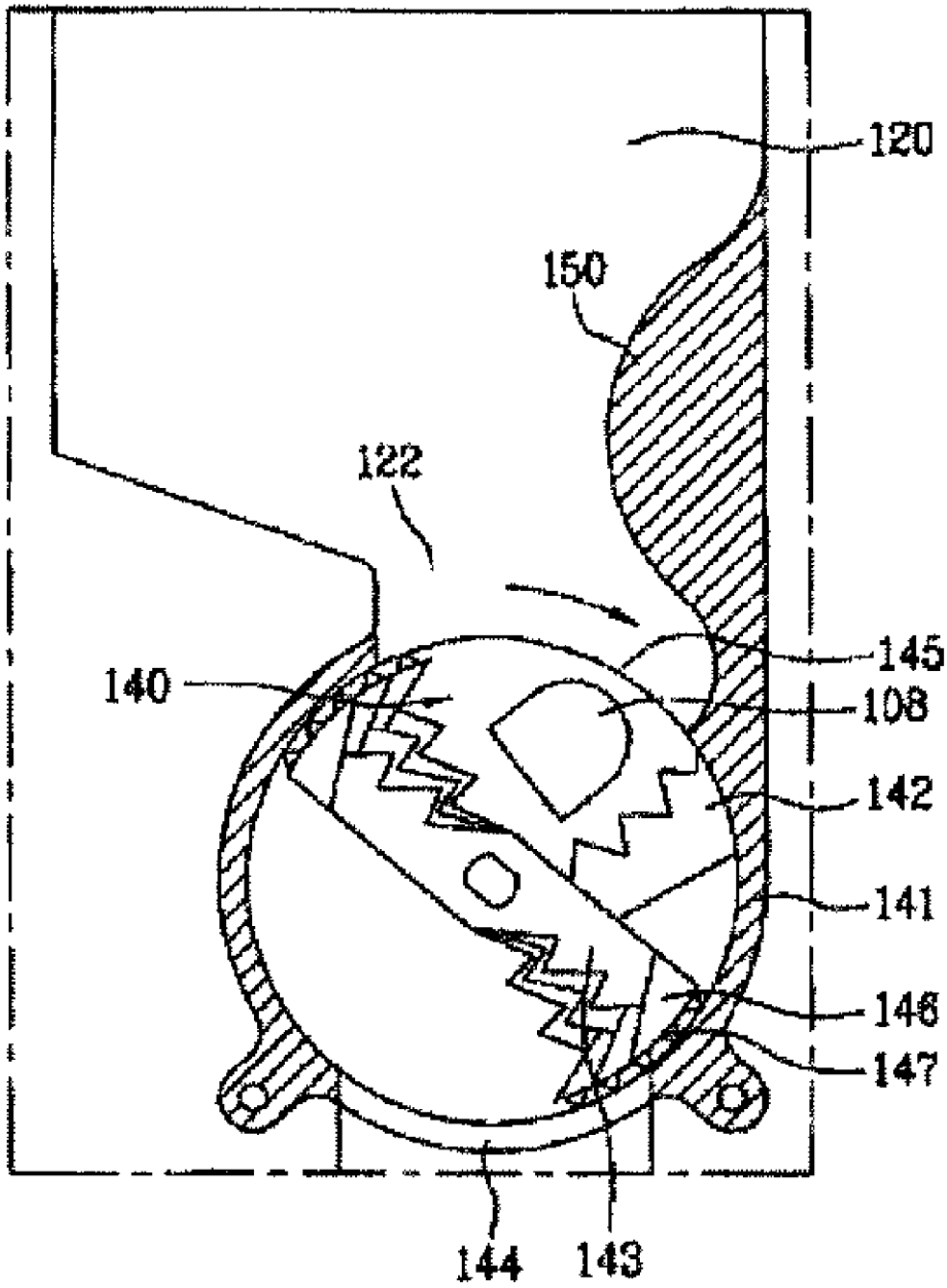
FIG. 2 is a cross sectional view illustrating an example of an ice supply device in a mode configured to supply sliced ice.
Figure 3:
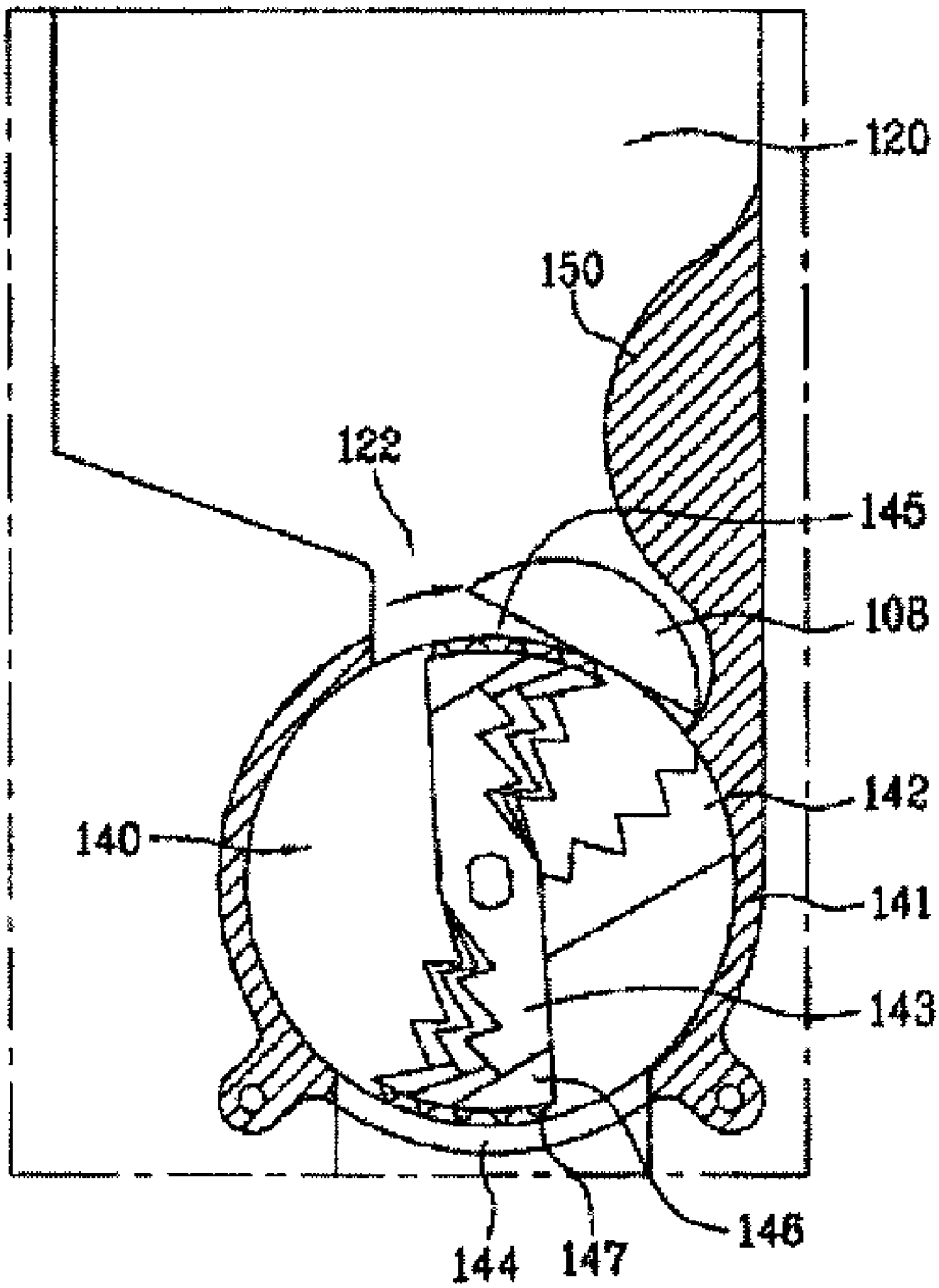
FIG. 3 is a cross sectional view illustrating an example of an ice supply device in a mode configured to supply grinded ice.

Referring to FIGS. 1 to 3, an ice supply device may be configured for placement in an appliance. For example, a refrigerator may include the ice supply device. In this example, the refrigerator may include an ice maker (not illustrated) configured to produce several pieces of cubed ice by using cold air of the refrigerator (e.g., in a freezer compartment of the refrigerator). The refrigerator or ice supplier in the refrigerator may also include an ice bank 120 configured to receive and store the pieces of cubed ice made by the ice maker. A door of the refrigerator may include a dispenser (not illustrated) configured to supply ice stored in the ice bank 120 and ejected from the ice supply device to users. The ice supply device may be separate from or may include the dispenser, the ice bank 120, and the ice maker.

In some implementations, the ice maker may include a tray (not illustrated) configured to automatically receive and retain water. The ice maker may be configured to make ice by cooling water retained in the tray with cold air of the refrigerator such that the water freezes into pieces in the shape of the tray. The ice maker may further include an ejector (not illustrated) configured to eject the pieces of ice from the tray and into the ice bank 120.

A side of the ice bank 120 may include an ice outlet 122 configured to allow ice to be ejected from the ice bank 120. The interior of the ice bank 120 may include a transfer device (not illustrated) configured to transfer ice stored in the ice bank 120 toward the ice outlet 122.

The ice maker or the ice bank 120 may be provided with a full ice level sensing device (not illustrated) configured to sense the amount of ice stored in the ice bank 120. When the full ice level sensing device senses that the ice in the ice bank 120 is insufficient, water may be automatically supplied to the tray and cooled with air from a cooling device provided in the refrigerator.

When a predetermined time passes or the temperature of the tray falls below a predetermined temperature, the ejector ejects the ice in the tray. The ice ejected from the tray by the ejector is stored in the ice bank 120 arranged under the ice maker. The ice may be stored in a shape produced by the tray (e.g., a cubed shape).

A dispenser may be provided with an ice chute connected to the ice outlet 122 of the ice bank 120 to form a path configured to eject ice from the ice bank 120. A user input element (e.g., a lever, a button, etc.) configured to drive the dispenser or the ice supply device by being pressed with a cup or hands of a user may be provided.

In some implementations, when a user presses a lever or a button configured to drive the dispenser or the ice supply device, the transfer device is driven to move the ice in the ice bank 120 to the ice outlet 122. The ice transferred by the transfer device may be supplied to a user by passing through the ice outlet 122 and the ice chute.

The ice may be processed by an ice processor 140 provided in the ice supply device. The ice processor 140 may be configured to process ice before the ice stored in the ice bank 120 is supplied to users through the dispenser.

For example, as illustrated in FIGS. 1 to 3, the ice processor 140 may be arranged under the ice bank 120. In some implementations, the ice processor may be arranged inside of the ice bank 120 or in another position along the ice discharge path.

The ice processor 140 may include a fixed blade 142, a rotary blade 143, and a housing 141 surrounding the fixed blade 142 and the rotary blade 143.

The housing 141, which is configured to accommodate the rotary blade 143 and the fixed blade 142, may be arranged under the ice bank 120. In some examples, an inlet 145 is formed on the upper part of the housing 141 and configured to communicate with the ice outlet 122 of the ice bank 120 to receive ice from the ice bank 120 into the housing 141. The housing 141 may also include an outlet 144 configured to allow ejection of ice from within the housing. The outlet 144 may be configured to communicate with the ice chute of the dispenser.

In some implementations, the fixed blade 142 is fixed in the housing 141 and has a blade unit that is capable of easily cutting the ice 108. As shown in FIGS. 1 to 3, the fixed blade 142 may be fixed at one side of the inside of the housing 141 such that the blade unit is arranged opposite to the inlet 145.

In some implementations, the rotary blade 143 is rotatably provided in the inside of the housing 141. The rotary shaft of the rotary blade 143 may be arranged to cross the center of the housing 141. The rotary shaft may be directly connected to a driver (not illustrated) such as a motor, etc., or may be indirectly connected to the driver by a gear assembly, etc. The gear assembly may include a driving gear rotated by the driver, and a driven gear connected with the rotary shaft of the rotary blade 143 and configured to be rotated by engaging with the driving gear.

The rotary blade 143 may extend in a radial direction from the driving shaft and may have a blade unit that is capable of easily cutting the ice 108 as described with respect to the fixed blade 142. FIGS. 1 to 3 illustrate examples showing a rotary blade 143 that extends from the rotary shaft to the inner circumference surface of the housing 141 in two directions. In some implementations, the rotary blade 143 may be extended in three or more directions or may extend in a single direction. Further, several fixed blades 142 and rotary blades 143 may be provided and configured to cross each other.

The ice 108 may be positioned between the rotary blades 143 and the fixed blades 142 and thereby cut into several slices by the rotating force of the blades when the rotary blade 143 rotates.

The rotating direction of the rotary blade 143 may be changed by the driver. For example, the driver may rotate the rotary blade 143 in the counterclockwise direction as illustrated in FIG. 1 or in the clockwise direction as illustrated in FIG. 2.

In the example shown in FIG. 1, the driver is configured to rotate the rotary blade 143 in the counterclockwise direction. In this example, the ice 108 is fed to the inside of the housing 141 and ejected in a state of the cubed ice through the outlet 144. Further, in this example, the ice 108 is not pressed between the blade units of the fixed blade 142 and the rotary blade 143. Instead, the ice 108 contacts a relatively flat or bladeless side of the rotary blade 143 and is thereby ejected through the outlet 144 bypassing the fixed blade 142. For example, the ice 108 enters the housing 141 and, because the rotary blade 143 is spinning in a counterclockwise direction, is guided away from the fixed blade and through the outlet 144 without contacting a blade unit (or with only incidental contact with a blade unit that is insufficient to significantly alter the shape of the ice 108). In other implementations, the fixed blade 142 and the rotary blade 143 may be configured such that cubed ice is ejected when the driver rotates the rotary blade 143 in the clockwise direction.

In the example shown in FIG. 2, the driver is configured to rotate the rotary blade 143 in the clockwise direction. In this example, the ice 108 is fed to the inside of the housing 141 after being dropped from the inlet 145. After entering the inside of the housing 141, the rotary blade 143 moves the ice 108 toward the fixed blade 142. As the rotary blade 143 spins in the clockwise direction, the ice 108 is pressed between the rotary blade 143 and the fixed blade 142 and thereby cut into two or more slices. The ice 108 cut into several slices may be ejected through the outlet 144 on the lower part of the housing 141. In other implementations, the rotary blade 143 and the fixed blade 142 may be configured such that sliced ice may be ejected when the driver rotates the rotary blade 143 in the counterclockwise direction.

In some implementations, the driver may be configured to regulate the rotating direction and the rotating speed of the rotary blade 143 included in the ice supply device. The ice supply device may be configured to output ice in various forms based on the direction and speed of the rotary blade 143. For example, the driver may rotate the rotary blade 143 at a low speed in the counterclockwise direction to dispense cubed ice (e.g., uncut ice). In another example, the driver may rotate the rotary blade 143 at a low speed in the clockwise direction to dispense sliced ice. In a further example, the driver may rotate the rotary blade 143 at a high speed in either the counterclockwise or clockwise direction to dispense grinded ice.

Referring to FIG. 3, the ice processor 140 includes a grinding member 146 configured to grind ice supplied from the ice bank 120 in a cubed form.

In some implementations, the grinding member 146 may be provided at more than one end of the rotary blade 143. As illustrated in FIG. 3, when the rotary blade 143 is extended to the inner circumference of the housing 141 in a plurality of directions, the grinding member 146 may be provided at all of the extended ends.

The grinding member 146 may be constructed as one or more separate members that can be coupled with the rotary blade 143 by welding, adhesion, or a coupling mechanism. In some examples, the grinding member 146 may be integrally formed with the rotary blade 143. For example, when the rotary blade 143 is formed of metal material, the grinding member 146 and the rotary blade 143 may be integrally cast in one piece of metal.

The grinding member 146 may be formed to have a curved surface forming an arc at the end of the rotary blade 143. In some examples, the outer circumference of the curved surface may be arranged to form a predetermined gap or distance with the inner circumference surface of the housing 141. In these examples, the outside surface of the grinding member 146 may form a curved surface facing the inner circumference surface of the housing 141, and a predetermined gap or distance may be maintained between all parts of the curved surface and the inner circumference surface of the housing 141.

The gap or distance may be maintained on the order of 5 to 10 mm. In some implementations, ice 108 may be grinded between the curved surface of the grinding member 146 and the inner circumference surface of the housing 141 when it passes through the inlet 145.

The grinding member 146 may include more than one protrusion 147 configured to grind the ice. The protrusion 147 may extend outward from the curved surface of the grinding member 146 to the inner circumference surface of the housing 141. In some implementations, a plurality of the protrusions 147 may be uniformly distributed on the curved surface.

In implementations in which the grinding member 146 includes the protrusion 147, the protrusion 147 may be formed so that its end maintains a predetermined gap with the inner circumference surface of the housing 141. In these implementations, the curved surface may be positioned apart from the inner circumference surface of the housing 141 by the length of the protrusion 147. The protrusion 147 may fill the gap or distance.

The gap or distance between the end of the protrusion 147 and the inner circumference surface may be maintained on the order of 5 to 1 mm. In some implementations, the ice 108 may be grinded between the end of the protrusion 147 of the grinding member 146 and the inner circumference surface of the housing 141 when it passes through the inlet 145 and into the housing 141.

Figure 4:
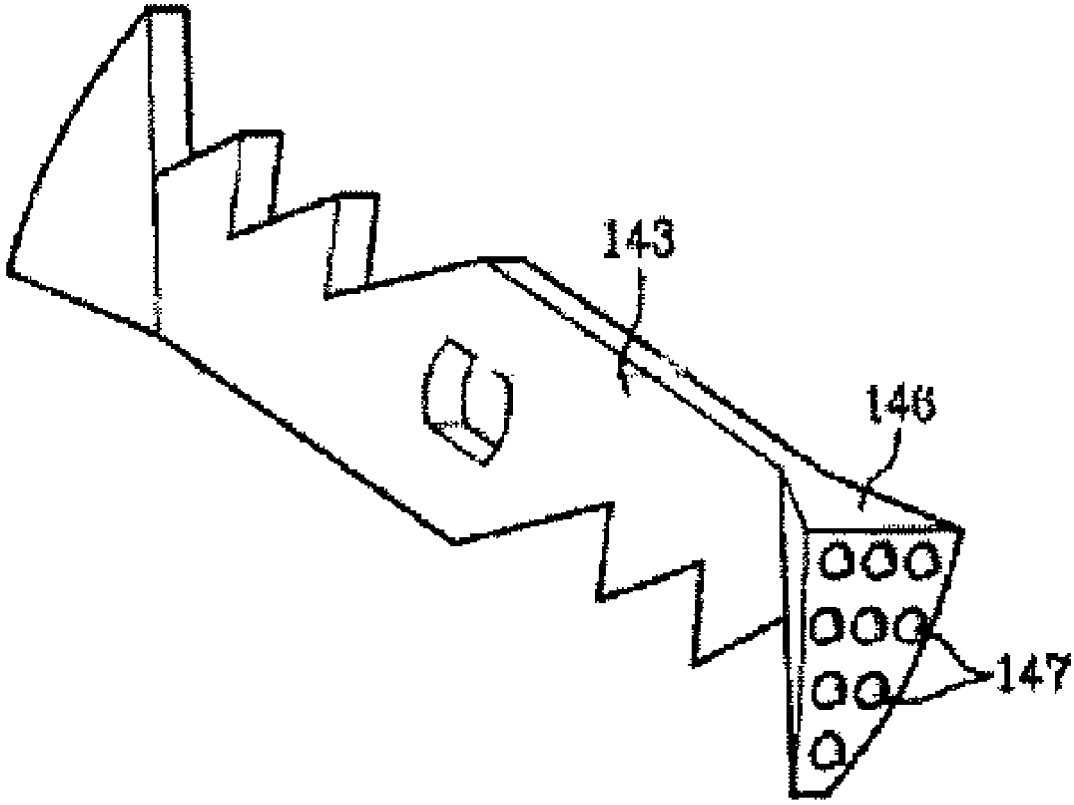
FIG. 4 is a perspective view illustrating an example of a rotary blade that includes a grinding member.

FIG. 4 illustrates an example of a rotary blade that includes a grinding member. For example, the grinding member 146 may be provided at the outside end of the rotary blade 143, and at least one protrusion 147 may be formed on the curved surface of the grinding member 146.

Effective grinding of the ice 108, may be realized when the outside of the grinding member 146 forms a curved surface, as illustrated in FIG. 4, and multiple protrusions 147 sharply protrude from the curved surface. The shape of the protrusion 147 is not limited to the shape illustrated in FIG. 4, but may include any shape capable of effectively grinding the ice 108 when the rotary blade 143 rotates at a high speed.

In examples in which the rotary blade 143 is configured to rotate at a high speed, the ice 108 dropped from the ice outlet 122 may be grinded by being contacted to the protrusion 147 in the vicinity of the inlet 145 before being dropped between the fixed blade 142 and the rotary blade 143.

In some implementations, the rotary blade 143 may be configured to rotate by a half circle again before the ice 108 of which the bottom is grinded drops between the rotary blade 143 and the fixed blade 142. In these implementations, the ice 108 may be grinded again by the same thickness as the distance between the protrusion and the inner circumference surface of the housing 141.

For example, in some implementations, the driver may be driven at 1400 rpm, the rotating speed of the rotary blade 143 may be reduced by ⅓ by the gear, and a double-bladed blade may be used as illustrated in FIGS. 1 to 3. The time "T" (seconds) from the time that the rotary blade 143 grinds the ice 108 once to the time that it grinds the ice again, may be obtained from the following formula:

$$T=1/(2\times1400\times(1/60)\times(1/3)\times(1-k))$$

where k is a rate occupying the arc of the end of the grinding member 146 against the circumference drawn by the end of the grinding member 146 when the rotary blade 143 rotates. In implementations in which the k is set at 0.25, the time T is about 0.0482 seconds.

The relation between the distance "X" (e.g., meters) of the free drop of a stopped object by gravity and the time is defined by the following formula:

$$X=1/2gt^2$$

where, the "g" represents the acceleration of gravity, and the "t" represents time. Therefore, the distance "X" that the ice 108 freely drops by gravity for 0.0482 second can be obtained from the following formula:

$$X=1/2\times9.8\times0.0482^2\approx0.011.$$

Therefore, the distance that the ice 108 drops during the time from when the rotary blade 143 grinds the ice 108 once to the time that it grinds the ice again, is about 1.1 centimeter. Therefore, when an alteration is needed, for example, the rotating speed of the rotating force provided by the driver may be raised, the reduction ratio of a gear may be lowered, the value of "k" may be raised, or the direction that the rotary blade 143 is formed may be increased to three or four directions. In some implementations, a time "T" from the time that the rotary blade 143 grinds the ice 108 once to the time that it grinds the ice again and the free drop distance "X" of the ice 108 may be reduced. In the examples described above, the ice 108 may be easily grinded by the protrusions 147 formed on the curved surface of the grinding member 146. Because the rotary blade 143 rotates at a high speed (e.g., a speed sufficient to enable grinding of ice), the ice 108 may be prevented from entering the housing 141 until after the ice 108 has contacted the protrusions 147 included on the grinding member 146 one or more times. Contact with the protrusions 147 at a high speed causes grinding of the ice 108 into fine pieces. The protrusions and grinding members may be configured such that rotation in either the clockwise or counterclockwise may grind ice.

Figure 5:
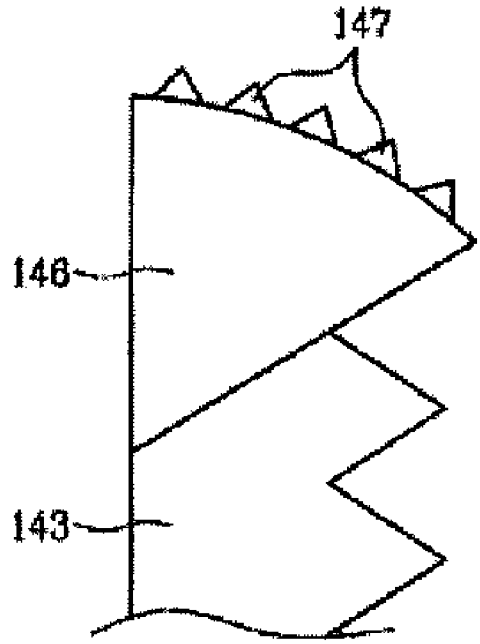
FIG. 5 is a cross sectional view illustrating an example of a rotary blade that includes a grinding member.

FIG. 5 illustrates an example of a rotary blade that includes a grinding member. In some implementations, the outside surface of the grinding member 146 on which the protrusions 147 are formed, may be smooth and curved to have the form of an arc, when it is shown from side as illustrated in FIG. 5. In these implementations, the protrusions may continuously maintain a state of contact with a bottom surface of ice 108 while the rotary blade 143 rotates by a predetermined angle.

Figure 6:
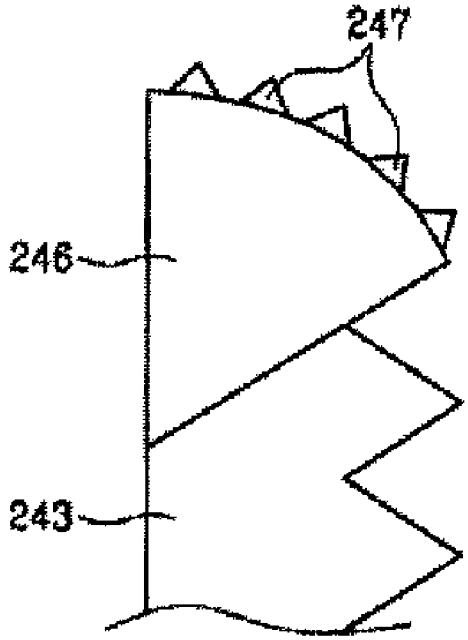
FIG. 6 is a cross sectional view illustrating an example of a rotary blade that includes a grinding member.

FIG. 6 illustrates an example of a rotary blade that includes a grinding member. For example, the outside surface of a grinding member 246 on which protrusions 247 are formed may be formed to be bent toward a rotating center (e.g., a rotating shaft). The outside surface of the grinding member 246 may be bent toward a front of the rotating direction of the rotary blade 243 when the rotary blade 143 is controlled to grind ice.

With the structure shown in FIG. 6, grinding of ice may be more efficient because the protrusions 247 positioned on the front begin to grind the lower part of the ice 108 at a relatively lower position and the protrusions 247 positioned at the rear may grind the ice 108 as the ice 108 is lifted upward.

When the rotary blade 143 grinds the ice 108 while being rotated at a high speed, the ice 108 may move in response to initial contact with the protrusion 147. In order to attempt to reduce or prevent this consequence, a separation preventing unit 150 may be formed in the vicinity of the inlet 145 to prevent separation of the ice 108 from the protrusion 147 or edge of the grinding member 146 when the ice is being grinded.

The separation preventing unit 150 may be formed to be protruded at one side of the housing 141 or the ice bank 120. The ice 108 initially contacted by the protrusion 147 in the high speed rotation of the rotary blade 143 may be caught by the lower part of the separation preventing unit 150 convexly protruded in the vicinity of the inlet 145, as illustrated in FIG. 3. In implementations in which the ice 108 is caught by the separation preventing unit 150, the ice 108 may be grinded by the protrusion 147 as the ice 108 is prevented from falling into the housing 141 or otherwise moving. For example, the separation preventing unit 150 holds the ice 108 in a position such that the bottom surface of the ice 108 is contacted or scraped by the protrusions included on the grinding member 146 as the rotary blade 143 rotates.

The driver may regulate the driving direction and speed of the rotary blade, thereby making it possible to selectively provide the cubed ice, the sliced ice, and the grinded ice to the users. A controller may control the speed and direction of the rotary blade 143 and may receive user input entered by a user with a user input element to determine how to control the rotary blade 143. For example, a user may select any one of the cubed ice, the sliced ice, and the grinded ice.

A controller (not illustrated) may be configured to control a function of the ice supply device and may also be configured to control the driver to regulate the driving direction and driving speed of the rotary blade, thereby providing any one of the cubed ice, the sliced ice, and the grinded ice, according to a selection of the user.

For example, when a user selects the cubed ice, the rotary blade 143 is controlled to rotate at a low speed in the direction opposite to the blade side of the rotary blade 143. In another example, when a user selects the sliced ice, the rotary blade 143 is controlled to rotate at a low speed in the direction of the blade side of the rotary blade. In a further example, when a user selects grinded ice, the rotary blade 143 is controlled to rotate at a higher speed (e.g., in either direction).

The ice provided to the user may be different based on controlling the direction of the rotating force and the rotating speed provided by the rotary blade 143.

In some implementations, when grinded ice is selected, the grinded condition of ice may be controlled by controlling the rotating speed of the rotary blade 143. For example, users may select the grinded degree of the ice, and the rotation speed of the rotary blade 143 may be controlled depending on the degree selected by the user. The grinded degree of the ice may be variously changed.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An appliance comprising:

an ice maker configured to make ice;

an ice storage bin configured to store ice made by the ice maker;

a dispenser including an ice dispensing chute;

an ice processing device configured to process ice in at least two shapes, the ice processing device including an outlet configured allow ice processed by the ice processing device to enter the ice dispensing chute;

a user input device configured to receive a selection of a shape of ice the user desires to dispense, the desired shape of ice corresponding to one of the at least two shapes; and a controller configured to control the ice processing device to process ice in the desired shape of ice to allow dispensing of the desired shape of ice by the dispenser, wherein the ice processing device includes a rotary blade that has a rotary shaft arranged to be perpendicular to a direction in which ice cubes enter an area occupied by the ice processing device, wherein the ice processing device includes a fixed blade that has a blade unit that is configured to cut ice cubes and that is arranged to face ice cubes dropping into the area occupied by the ice processing device such that at least some ice cubes dropping into the area occupied by the ice processing device fall into the blade unit of the fixed blade based on the force of gravity unless guided by the rotary blade to bypass the fixed blade, wherein the controller is configured to control the ice processing device to rotate the rotary blade in a first direction at a first speed to process ice in the first shape, and wherein the controller is configured to control the ice processing device to rotate the rotary blade in a second direction at a second speed to process ice in the second shape that is different than the first shape, the second direction being opposite the first direction and the second speed being faster than the first speed.

2. The appliance as claimed in claim 1, wherein:

the controller is configured to control a direction of rotation and a speed of rotation of the rotary blade to process ice in the desired shape of ice.

3. The appliance as claimed in claim 2, wherein the rotary blade includes a relatively sharp side, a relatively dull side, and at least one protrusion extending from and positioned on a circumferential surface of an end of the rotary blade.

4. The appliance as claimed in claim 1, wherein the controller is configured to control the rotary blade to rotate at a speed sufficient to ensure a typical ice piece contacts an outer circumferential surface of the rotary blade.

5. The appliance as claimed in claim 1, wherein the user input device is configured to receive a selection of one of cubed ice, sliced ice, and grinded ice.

6. An appliance comprising:

an ice maker configured to make ice;

an ice storage bin configured to store ice made by the ice maker;

a dispenser including an ice dispensing chute;

an ice processing device configured to process ice in at least two shapes, the ice processing device including an outlet configured to allow ice processed by the ice processing device to enter the ice dispensing chute, the ice processing device comprising:

a fixed blade, and a rotary blade configured to rotate in a first direction to process ice in a first shape and rotate in a second direction that is opposite the first direction to process ice in a second shape that is different than the first shape;

a user input device configured to receive a selection of a shape of ice the user desires to dispense, the desired shape of ice corresponding to one of the at least two shapes; and a controller configured to control the ice processing device to process ice in the desired shape of ice to allow dispensing of the desired shape of ice by the dispenser, wherein the ice storage bin includes an inclined surface configured to guide, by force of gravity, an ice cube in the ice storage bin from above the ice processing device to drop into an area occupied by the ice processing device, wherein the controller is configured to:

in response to the desired shape of ice being the first shape, rotate the rotary blade in the first direction at a first speed to cause the rotary blade to guide the ice cube dropped into the area occupied by the ice processing device through the outlet without contacting the fixed blade, and in response to the desired shape of ice being the second shape, rotate the rotary blade in the second direction at a second speed to cause the rotary blade to guide the ice cube dropped into the area occupied by the ice processing device toward the fixed blade to cut the ice cube into two or more pieces before passing through the outlet the second speed being faster than the first speed, wherein a rotary shaft of the rotary blade is arranged to be perpendicular to a direction in which ice cubes enter the area occupied by the ice processing device, and wherein the fixed blade includes a blade unit that is configured to cut ice cubes and that is arranged to face ice cubes dropping into the area occupied by the ice processing device such that at least some ice cubes dropping into the area occupied by the ice processing device fall into the blade unit of the fixed blade based on the force of gravity unless guided by the rotary blade to bypass the fixed blade.

7. The appliance as claimed in claim 6, wherein the first shape is a cubed shape, the second shape is a sliced shape, and the user input device is configured to receive a selection of one of cubed ice and sliced ice.

8. The appliance as claimed in claim 6, wherein the rotary blade includes a relatively sharp side and a relatively dull side.

9. The appliance as claimed in claim 8, wherein the rotary blade is configured such that the relatively dull side of the rotary blade contacts the ice cube dropped into the area occupied by the ice processing device when the rotary blade is rotated in the first direction and the relatively sharp side of the rotary blade contacts the ice cube dropped into the area occupied by the ice processing device when the rotary blade is rotated in the second direction.

10. The appliance as claimed in claim 6, wherein the ice storage bin includes multiple inclined surfaces configured to guide, by force of gravity, ice cubes in the ice storage bin toward the ice processing device.

11. The appliance as claimed in claim 10, wherein the multiple inclined surfaces include inclined surfaces positioned at opposite sides of the ice storage bin.

12. The appliance as claimed in claim 6, wherein the rotary blade extends from the rotary shaft to an inner circumference surface of the ice storage bin.

13. The appliance as claimed in claim 6, wherein the rotary blade extends from the rotary shaft to an inner circumference surface of the ice storage bin.

* * * * *